US009676451B1

(12) United States Patent
Marceau

(10) Patent No.: US 9,676,451 B1
(45) Date of Patent: Jun. 13, 2017

(54) BILGE PLUG SAVER DEVICE

(71) Applicant: Jason D. Marceau, Alton Bay, NH (US)

(72) Inventor: Jason D. Marceau, Alton Bay, NH (US)

( * ) Notice: Subject to any disclaimer, the term of this patent is extended or adjusted under 35 U.S.C. 154(b) by 0 days.

(21) Appl. No.: 14/819,018

(22) Filed: Aug. 5, 2015

Related U.S. Application Data

(60) Provisional application No. 62/033,168, filed on Aug. 5, 2014.

(51) Int. Cl.
*B63B 13/00* (2006.01)
*A45C 13/00* (2006.01)

(52) U.S. Cl.
CPC ..... *B63B 13/00* (2013.01); *A45C 13/008* (2013.01)

(58) Field of Classification Search
CPC ..... B63B 13/00; B63B 13/02; A45C 13/008; A45C 3/10; A45C 11/22
USPC ..... D03/300
See application file for complete search history.

(56) References Cited

U.S. PATENT DOCUMENTS 1,979,460 A * 11/1934 Forsberg ..... B25B 15/02 81/436
2001/0011446 A1* 8/2001 McClean ..... B65D 43/169 53/452
2006/0254392 A1* 11/2006 Frank ..... B25B 13/48 81/52
2013/0193006 A1* 8/2013 Bergreen ..... A45C 11/22 206/37

* cited by examiner

*Primary Examiner* — Andrew Polay
(74) *Attorney, Agent, or Firm* — Michael J. Persson; Catherine Napjus; Lawson Persson & Chisholm

(57) ABSTRACT

The bilge plug saver of the present invention includes a large piece and a small piece made of a waterproof material, preferably rubber. The large and small piece fit together to form a waterproof capsule sized and shaped to accommodate a bilge plug within the capsule.

12 Claims, 2 Drawing Sheets

BILGE PLUG SAVER DEVICE

CLAIM OF PRIORITY

This application is a non-provisional application claiming the benefit of priority of U.S. Provisional Patent Application Ser. No. 62/033,168, filed on Aug. 5, 2014.

FIELD OF THE INVENTION

The present invention relates generally to boating accessories, and specifically to a bilge plug holder that aids in prevention of the loss of the bilge pump plug.

BACKGROUND

The bilge area on a boat is the lowest area of the boat, where water and other liquid collect. Most boats include a bilge drain hole at the bottom of the bilge area or the back of the boat. These holes are securely closed within bilge plugs. While the boat us underway, if the bilge plug is removed, suction will cause any liquid in the bilge area to drain out of the boat through the bilge drain holes. When the boat is at rest, however, the bilge holes are just holes in the boat that will cause the boat to fill with water if not plugged. Even very high-powered bilge pumps are unable to remove liquid at the same or a greater rate than the rate at which water will enter the boat through the bilge drain hole when the boat is not moving. The bilge plug is therefore a very important device to ensure the seaworthiness of the boat and the safety of its passengers. Unfortunately, given that bilge plugs are generally small and dense, they are misplaced or lost all too easily. Even if not lost, the hard metal of the bilge plug may scratch or otherwise damage a surface on which it is placed while the boat is draining. Therefore there is a need for a device to hold the bilge plug while it is not positioned in a bilge hole so that it is unlikely to be lost or to damage the boat.

SUMMARY OF THE INVENTION

The present invention is a bilge plug saver and a bilge plug saver kit.

In its most basic form, the bilge plug saver of the present invention includes a large piece and a small piece made of a waterproof material, preferably rubber. The large and small piece fit together to form a waterproof capsule sized and shaped to accommodate a bilge plug within the capsule. It is preferred that the waterproof material be sufficiently tacky so that the small and large pieces will remain securely together not only because of their snug fit, but also because they will stick to one another. Each of the small piece and large piece is therefore approximately cylindrical with one of the open sides of the cylinder closed so that it has an open end and a closed end. The open ends of the small and large pieces are intended to be fit together so that both ends of the cylinder are closed. It is preferred that the edges where the cylindrical part of the small and large pieces meet the closed ends of the respective pieces be rounded. Each piece has a length and a diameter. The small piece fits snugly within the large piece, and therefore is only "smaller" than the large piece in that its diameter is slightly smaller than that of the large piece. Indeed, the length of the "small" piece may actually be greater than the length of the large piece. The material out of which the small and large pieces is made is preferably sufficiently tacky so that the small and large pieces will remain securely together not only because of their snug fit, but also because they will stick to one another. Each of the small piece and large piece includes a perimeter measured around the respective open ends.

Although the preferred bilge plug saver has a round body as described above, and as would be expected for accommodating round bilge plugs, it is understood that the bilge plug saver may also have different shapes, such as rectangular or triangular. The bilge plug saver may be any shape that will accommodate the bilge plug within. As such, although terms such as "diameter" are used to describe the preferred round embodiment, it is understood that "diameter" may refer to the corresponding measure of a differently shaped embodiment of the bilge plug saver. For example, if the bilge plug saver has a square cross section, then the "diameter" would be the distance from one side to the side opposite, or the length of one of the sides.

An alternate embodiment of the bilge plug saver includes an inner catch around the small piece and an outer catch around the large piece. The inner catch is a bulge around the circumference of the small piece near its open end. The outer catch is a corresponding bulge around the circumference of the large piece near its open end. The outer catch is slightly larger than the inner catch and is substantially hollow so that the inner catch may fit into the outer catch and be held there, thus holding the small and large pieces together.

It is preferred that one of the pieces of the bilge plug saver includes a ring through which a lanyard or other stringy piece may be threaded. It is preferred that this ring be included on the large piece, but may be included on the small piece. It is preferred that the piece including the ring be a single integrated piece, rather than the ring being attached to the piece. In other words, it is preferred that the piece including the ring be formed from a single mold. In versions of the bilge plug saver that include a ring, it is preferred that the bilge plug saver also include a lanyard sized to fit through the ring so that the bilge plug saver may be worn around a wrist or hooked or hung on something, such as a ring or cleat mounted to a transom of a boat. The preferred lanyard is a rubber loop with a circumference of approximately 11-13 inches. This preferred lanyard is looped through the ring and secured thereto with a cow hitch or lark's head knot.

In some embodiments of the bilge plug saver, a loop is included on one of the large or small pieces so that the piece is a single integrated piece. This embodiment is therefore similar to the embodiment including a ring and a lanyard, but there is no need for the ring to secure the lanyard and the loop takes the place of the lanyard. In this embodiment the piece that includes the loop and the loop would be formed from a single mold. It is preferred that the piece that includes the loop be the large piece.

It is preferred that the large and small pieces be different colors. This is so that the pieces are clearly distinguishable from one another and so that when they are fitted together, their intersection is apparent. It is preferred that the large piece be red and the small piece be white. The bright colors will make them easy to spot against more subdued colors that are common on boats.

As bilge plugs come in a wide variety of sizes and shapes, it is understood that the bilge plug saver of the present invention similarly comes in several sizes and shapes to accommodate a variety of bilge plugs.

In its most basic form, the bilge plug saver kit of the present invention includes a bilge plug saver of the present invention, as described above, and a bilge plug. Any bilge plug commonly used in the art may be included in the kit of the present invention.

These aspects of the present invention are not meant to be exclusive and other features, aspects, and advantages of the present invention will be readily apparent to those of ordinary skill in the art when read in conjunction with the following description, accompanying drawings, and claims.

DETAILED DESCRIPTION

Figure 1A:
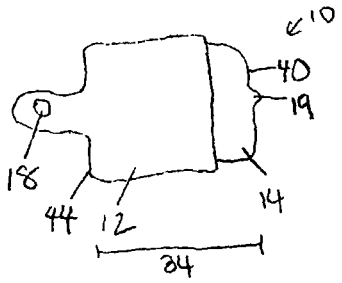
FIG. 1A is a side view of the bilge plug saver of the present invention with the small and large pieces fitted together.
Figure 1B:
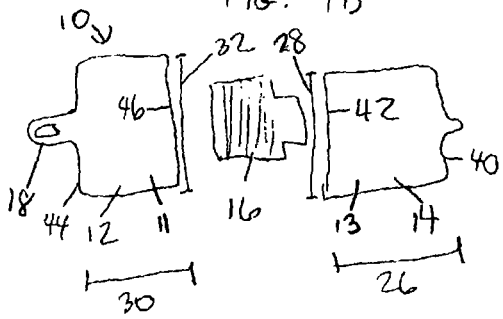
FIG. 1B is a side view of the small and large pieces of the bilge plug saver of the present invention separated with a bilge plug between them.
Figure 1C:
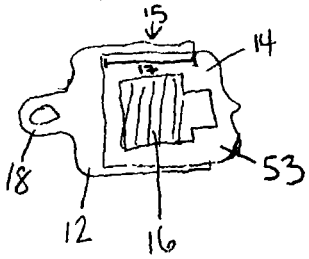
FIG. 1C is a side cutaway view of the bilge plug saver of the present invention encapsulating a bilge plug.

Referring first to FIGS. 1A-1C, several views of bilge plug saver 10 of the present invention are provided. FIG. 1A is a side view of large piece 12 and small piece 14 fitted together. When large piece 12 and small piece 14 are fitted together, bilge plug saver 10 has total length 34, measured between large piece closed end 44 and small piece closed end 42. The embodiment shown has large piece 12 including ring 18 so that large piece 12 and ring 18 are one integrated piece. FIG. 1B shows large piece 12 and small piece 14 separated with a bilge plug 16 between them. It is understood that bilge plug 16 will fit within cavity 53 created when large piece 12 and small piece 14 are fit together, as shown in FIG. 1A. Large piece 12 has large piece body 11. Small piece 14 has small piece body 13. Large piece 12 has large piece length 30 and diameter 32. Small piece 14 has small piece length 26 and diameter 28. Large piece 12 has closed end 44 and open end 46. Small piece 14 has closed end 40 and open end 42. FIG. 1C is a cutaway view of the view shown in FIG. 1A. Small piece 14 is shown snugly fit into large piece 12 and bilge plug 16 is shown within cavity 53 formed by their union. There is an overlap 15 where large piece 12 fits over small piece 14 when they are positioned together, as intended. This overlap 15 has a length 17.

Bilge plug saver 10, as shown in FIGS. 1A-1C, has a total length 34 of approximately 1.5±0.25 inches when small and large pieces 14, 12 are fit together. This total length 34 is measured from closed end 44 of large piece 12 to closed end 40 of small piece 14 when they are fit together, and does not include any additions to either piece, such as ring 18 or loop 24 (shown in FIG. 3B). Total length 34 is therefore small piece length 26 plus large piece length 30 minus overlap length 17. Large piece length 30 is preferably approximately 1±0.25 inches. Small piece length 26 is preferably approximately 1.25±0.25 inches. Large piece diameter 32 is preferably approximately 1.25±0.25 inches. Small piece diameter 28 is slightly smaller and is preferably approximately 1±0.25 inches. The closed end 40, 44 of small and large pieces 14, 12 may include a protrusion 19, as shown. Such protrusions 19 are nipple-shaped and designed to accommodate bilge plugs 16, such as the one shown in FIG. 5C, which has a corresponding nipple-like structure. Protrusion 19 may be incorporated into either closed end 40, 44.

Bilge plug 16 is a common bilge plug that may be used with either of the preferred embodiments of bilge plug saver 10 shown in FIGS. 1 and 2. Bilge plug 16 is a brass ½ inch NTP plug. It is approximately 1±0.125 inches in total length, approximately 0.5 inches of which is threaded, and the remainder of which is smooth and square. It weighs approximately 50±10 grams.

Figure 1D:
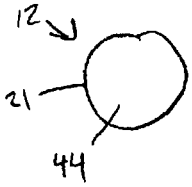
FIG. 1D is a top down view of the open end of the large piece.
Figure 1E:
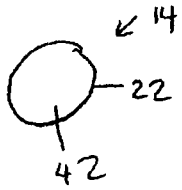
FIG. 1E is a top down view of the open end of the small piece.

Now referring to FIGS. 1D and 1E, top down views of open end 42 of small piece 14 and open end 46 of large piece 12 or shown, respectively. The distances around the open ends 42, 46 are small piece perimeter 23 and large piece perimeter 21, respectively. Large piece perimeter 21 is slightly larger than small piece perimeter 23 so that open end 42 of small piece 14 may fit snugly into open end 46 of large piece 12. As shown, it is preferred that large and small pieces 12, 14 be round.

Figure 2A:
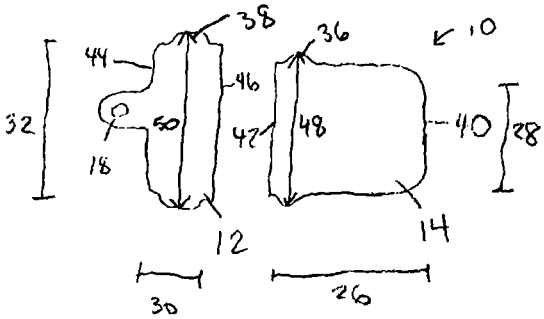
FIG. 2A is a side view of an alternate embodiment of the bilge plug saver of the present invention including inner and outer bulges with the large and small pieces separated.
Figure 2B:
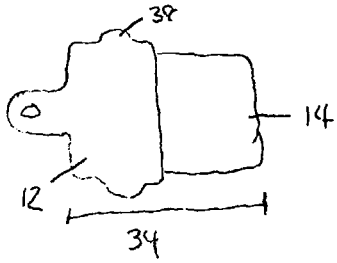
FIG. 2B is a side view of the alternate embodiment of the bilge plug saver of the present invention including inner and outer bulges with the large and small pieces fitted together.

Now referring to FIG. 2A, an alternate embodiment of bilge plug saver 10 is provided. This embodiment includes inner bulge 36 around perimeter 23 of small piece 14 near open end 42 and outer bulge 38 around perimeter 21 of large piece 12 near open end 46. Outer bulge 38 is slightly larger than inner bulge 38 and is substantially hollow so that inner bulge 36 fits into outer bulge 38, as shown in FIG. 2B. When inner bulge 36 is held by outer bulge 38, small and large pieces 12, 14 are held together. Although the embodiment of bilge plug saver 10 shown in FIGS. 2A and 2B are shown with ring 18, it is understood that ring 18 may be substituted with loop 24, as shown in FIG. 3B, or omitted.

Bilge plug saver 10, as shown in FIGS. 2A and 2B, has total length 34 of approximately 1.5±0.25 inches when the small and large pieces 14, 12 are fit together. Large piece length 30 is preferably approximately 0.75±0.25 inches. Small piece length 26 is preferably approximately 1.5±0.25 inches. Large piece diameter 32 is preferably approximately 1.25±0.25 inches. Small piece diameter 28 is slightly smaller and is preferably approximately 1±0.25 inches. Diameter 48 of inner bulge 36 at its widest point is approximately 1.125±0.125 inches. Diameter 50 of outer bulge 38 at its widest point is approximately 1.25±0.125 inches.

Figure 3A:
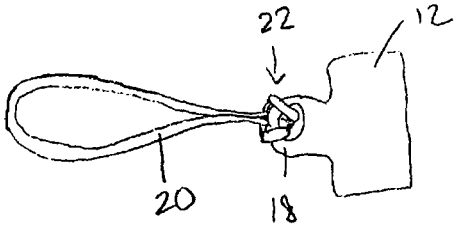
FIG. 3A is a side view of a large piece of a bilge plug saver of the present invention that includes a ring and a lanyard.
Figure 3B:
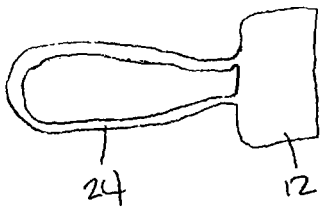
FIG. 3B is a side view of an alternative embodiment of a large piece of a bilge plug saver of the present invention that includes a loop.

Now referring to FIGS. 3A and 3B, various embodiments of large piece 12 are shown. In the embodiment shown in FIG. 3A, bilge plug saver 10 includes lanyard 20. The preferred lanyard 20, as shown, is a loop that may be threaded through ring 18 and secured to it with a cow hitch or lark's head knot 22, as shown. The other end of lanyard 20 could be hooked onto something or worn around the wrist. In addition, the entire remainder of bilge plug saver 10 may loop through lanyard 20 so that bilge plug saver 10 may also be secured to something using a second cow hitch or lark's head knot. The embodiment shown in FIG. 3B includes loop 24 integrated into large piece 12 so that they are a single integrated piece. This embodiment eliminates ring 18. This embodiment may also be hooked onto something, worn around the wrist, or secured to something using a cow hitch or lark's head knot.

Figure 4A:
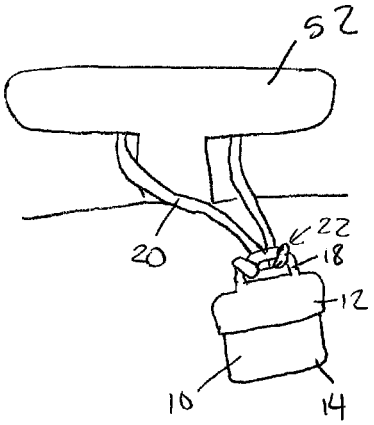
FIG. 4A is a view of a bilge plug saver of the present invention attached to a cleat of a boat.
Figure 4B:
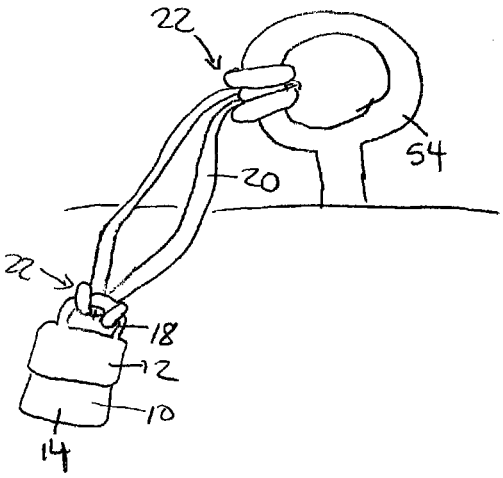
FIG. 4B is a view of a bilge plug saver of the present invention attached to a ring of a boat.

Now referring to FIGS. 4A and 4B, bilge plug saver 10 is shown in use with a boat cleat 52 and boat ring 54, respectively. In FIG. 4A, lanyard 20 is shown looped around boat cleat 52, and thereby secured thereto. In FIG. 4B, lanyard 20 is shown secured to boat ring 54 with a second cow hitch or lark's head knot 22. It is understood that in other embodiments, lanyard 20 may be replaced with loop 24 or another fastening device.

Figure 5A:
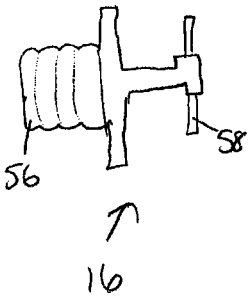
FIGS. 5A-5C are views of different types of bilge plugs that may be a part of the bilge plug kit of the present invention.
Figure 5B:
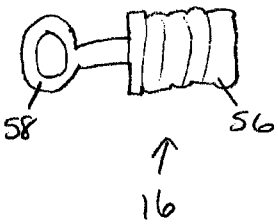
Figure 5C:
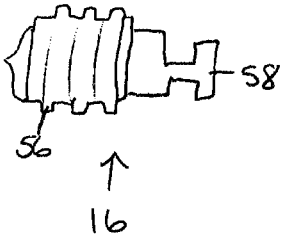

Now referring to FIGS. 5A-5C various alternative bilge plugs 16 that may be a part of the bilge plug kit of the present invention are shown. Bilge plug 16 shown in FIGS. 1B and 1C is all metal, as described above. Bilge plugs 16 shown in FIGS. 5A-5C, on the other hand are a combination of plastics, metals, and rubbers. Each includes a rubberized portion 56 that will be inserted into the bilge drain hole. The rubberized nature of this portion allows for a watertight fit into the bilge drain hole. Each bilge plug 16 also includes a handle portion 58 that will be handled by the user removing and replacing bilge plug 16. Handle portions 58 vary in what they are made out of, but are commonly made of metal, plastic, or a combination thereof. The bilge plugs 16 shown in FIGS. 1B, 1C, and 5A-5C are common bilge plugs and are understood to be an exemplary sampling of a wide variety of bilge plugs 16 that may be a part of the bilge plug kit of the present invention. It is further understood that the bilge plug saver 10 of the present invention may be adapted in size and shape to accommodate each of this wide variety of bilge plugs 16.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

What is claimed is:

1. A bilge plug saver comprising:

a large piece comprising:

a large piece body with a large piece open end and a large piece closed end;

a large piece length as measured between said large piece open end and said large piece closed end; and a large piece perimeter as measured around said large piece open end;

a small piece, sized and dimensioned to snugly fit within said large piece, comprising:

a small piece body with a small piece open end and a small piece closed end;

a small piece length as measured between said small piece open end and said small piece closed end; and a small piece perimeter as measured around said small piece open end, wherein said large piece perimeter is slightly greater than said small piece perimeter such that said small piece body fits snugly into said large piece body;

wherein:

said large piece and said small piece are made of waterproof material that is rubber;

a cavity formed within a union of said small piece and said large piece when said small piece is disposed within said large piece open end, wherein said cavity is large enough to accommodate a bilge plug;

a total length as measured between said large piece closed end and said small piece closed end when said large piece and said small piece are positioned together, wherein said total length is equal to a sum of said large piece length and said small piece length less a length of an overlap between said large piece and said small piece;

said large piece body and said small piece body are round such that said large piece perimeter is a large piece circumference and said small piece perimeter is a small piece circumference and said large piece body comprises a large piece diameter measured across said large piece open end and said small piece body comprises a small piece diameter measured across said small piece open end;

said large piece body comprises a large piece bulge, extending away from said cavity, disposed between said large piece closed end and said large piece open end, following said large piece perimeter and comprising a large piece bulge diameter, wherein said large piece bulge diameter is greater than said large piece diameter;

said small piece body comprises a small piece bulge, extending away from said cavity, disposed between said small piece closed end and said small piece open end, following said small piece perimeter and comprising a small piece bulge diameter, wherein said small piece bulge diameter is greater than said small piece diameter; and said large piece bulge is slightly larger than said small piece bulge such that when said large piece and said small piece are positioned together, said small piece bulge fits snugly within said large piece bulge and acts as a catch to hold said large piece and said small piece together.

2. The bilge plug saver as claimed in claim 1, further comprising a loop integrated into and extending from said large piece closed end.

3. The bilge plug saver as claimed in claim 1, further comprising a loop integrated into and extending from said small piece closed end.

4. The bilge plug saver as claimed in claim 1, further comprising a ring integrated into and extending from said large piece closed end.

5. The bilge plug saver as claimed in claim 4, further comprising a lanyard sized and dimensioned to fit through said ring.

6. The bilge plug saver as claimed in claim 1, further comprising a ring integrated into and extending from said small piece closed end.

7. The bilge plug saver as claimed in claim 6, further comprising a lanyard sized and dimensioned to fit through said ring.

8. The bilge plug saver as claimed in claim 1, wherein said large piece body and said small piece body are round, such that said small piece open end and said large piece open end are circles.

9. A bilge plug saver kit comprising:

a bilge plug; and a bilge plug saver comprising:

a large piece comprising:

a large piece body with a large piece open end and a large piece closed end;

a large piece length as measured between said large piece open end and said large piece closed end; and a large piece perimeter as measured around said large piece open end;

a small piece, sized and dimensioned to snugly fit within said large piece, comprising:

a small piece body with a small piece open end and a small piece closed end;

a small piece length as measured between said small piece open end and said small piece closed end; and a small piece perimeter as measured around said small piece open end, wherein said large piece perimeter is slightly greater than said small piece perimeter such that said small piece body fits snugly into said large piece body;

wherein:

said large piece and said small piece of said bilge plug saver are made of waterproof material that is rubber;

a total length as measured between said large piece closed end and said small piece closed end when said large piece and said small piece are positioned together, wherein said total length is equal to a sum of said large piece length and said small piece length less a length of an overlap between said large piece and said small piece;

a cavity formed within a union of said small piece and said large piece when said small piece is disposed within said large piece open end, wherein said cavity is large enough to accommodate said bilge plug disposed therein;

said large piece body and said small piece body are round such that said large piece perimeter is a large piece circumference and said small piece perimeter is a small piece circumference and said large piece body comprises a large piece diameter measured across said large piece open end and said small piece body comprises a small piece diameter measured across said small piece open end;

said large piece body comprises a large piece bulge extending away from said cavity, disposed between said large piece closed end and said large piece open end, following said large piece perimeter and comprises a large piece bulge diameter, wherein said large piece bulge diameter is greater than said large piece diameter;

said small piece body comprises a small piece bulge extending away from said cavity, disposed between said small piece closed end and said small piece open end, following said small piece perimeter and comprises a small piece bulge diameter, wherein said small piece bulge diameter is greater than said small piece diameter; and said large piece bulge is slightly larger than said small piece bulge such that when said large piece and said small piece are positioned together, said small piece bulge fits snugly within said large piece bulge and acts as a catch to hold said large piece and said small piece together.

10. The bilge plug saver kit as claimed in claim 9, further comprising a loop integrated into and extending from said large piece closed end.

11. The bilge plug saver kit as claimed in claim 9, further comprising:

a ring integrated into and extending from said large piece closed end; and a lanyard sized and dimensioned to fit through said ring.

12. The bilge plug saver kit as claimed in claim 9, wherein said large piece body and said small piece body are round, such that said small piece open end and said large piece open end are circles.

* * * * *